US007669947B2

(12) United States Patent
Bradford et al.

(10) Patent No.: US 7,669,947 B2
(45) Date of Patent: Mar. 2, 2010

(54) INDUSTRIAL INK JET PRINT HEAD SYSTEM

(75) Inventors: Bruce Bradford, Fredrick, MD (US); David Don, Bethesda, MD (US); Edward Reagan, McLean, VA (US); Daryl Betton Turner, Laurel, MD (US)

(73) Assignee: RSI Systems, LLC, Gaithersburg, MD (US)

( * ) Notice: Subject to any disclaimer, the term of this patent is extended or adjusted under 35 U.S.C. 154(b) by 558 days.

(21) Appl. No.: 11/518,925

(22) Filed: Sep. 12, 2006

(65) Prior Publication Data

US 2007/0263043 A1 Nov. 15, 2007

Related U.S. Application Data

(60) Provisional application No. 60/798,936, filed on May 10, 2006.

(51) Int. Cl.
*B41J 3/00* (2006.01)
*B41J 2/165* (2006.01)
*B41J 2/01* (2006.01)

(52) U.S. Cl. ..... 347/4; 347/22; 347/29; 347/104

(58) Field of Classification Search ..... 347/84, 347/29, 22, 104, 4
See application file for complete search history.

(56) References Cited

U.S. PATENT DOCUMENTS

| | | | | |
|---|---|---|---|---|
| 4,426,652 | A * | 1/1984 | Horike et al. | 347/76 |
| 6,065,831 | A * | 5/2000 | Kawaura et al. | 347/108 |
| 6,151,045 | A * | 11/2000 | Beach et al. | 347/45 |
| 6,312,082 | B1 * | 11/2001 | Lund et al. | 347/19 |
| 2002/0097283 | A1 * | 7/2002 | Askren et al. | 347/7 |
| 2003/0214557 | A1 * | 11/2003 | Nakamura et al. | 347/49 |

* cited by examiner

*Primary Examiner*—Julian D Huffman
*Assistant Examiner*—Sarah Al-Hashimi
(74) *Attorney, Agent, or Firm*—Herman Hohauser

(57) ABSTRACT

A print mechanism positioned in a housing having a pivotably mounted cover and including a ink flow regulator operatively connected to a print cartridge and provided with a plurality of seals to prevent contamination and damage from unwanted ink flow.

1 Claim, 8 Drawing Sheets

INDUSTRIAL INK JET PRINT HEAD SYSTEM

CROSS REFERENCE TO RELATED PATENT APPLICATION

This Application is related to and claims the benefit under 35USC 119(e) for the Provisional Patent Application of the same title having Ser. No. 60/798,936 filed on May 10, 2006.

FIELD OF THE INVENTION

This invention relates to ink jet printing. More specifically, the invention pertains to a system that uses an ink jet printing mechanism in conjunction with an ink supply mechanism and custom enclosure for the purpose of adapting existing ink jet printer technology for use in industrial printing applications. Such applications include but are not limited to the printing of bar codes, text or images on substrates such as paper, cardboard, ceramic tile, wood, concrete, plastic, metal, fabric and cloth.

BACKGROUND OF THE INVENTION

Ink Jet printing is a common method of non-impact printing. An ink jet printer emits intermittent streams of ink droplets from tiny nozzles in response to received electrical signals. The inventive device is applicable to all types of ink jet printers.

When used in industrial applications, conventional ink jet printers suffer from a variety of drawbacks and disadvantages. For example, when an ink jet print mechanism becomes damaged the printing process must be stopped until the print system can be restored to proper operational status. For ink jet print systems containing custom ink jet print mechanism an operator must stop an assembly line and physically disconnect the ink jet printer from its ink supply and mounting so that it can be removed for maintenance. This is a time consuming and often expensive process, both in terms of lost production stemming from a shut down line and the maintenance costs associated with servicing the ink jet print system.

Additionally, ink contamination of print media is a common a problem resulting from a damaged ink jet print mechanism or low ink condition. In the case of damaged ink jet print mechanism, improperly designed systems allow ink to leak from the print mechanism directly onto a print skid plate—the surface the print medium rests flush against during the printing process. This causes ink contamination: smearing and smudging on the print medium. Moreover, most ink jet printers must "pull" their ink from a regulator, such that the ink pressure in the ink jet print mechanism and corresponding feed line is less than atmospheric pressure (it is in a vacuum). This prevents ink from flowing freely out of the ink jet print mechanism. In print systems wherein the ink reservoir does not have a method of warning the operator of a low ink condition, the supply ink pressure may go below the pressure required by the pressure regulator to keep negative pressure in the ink jet print mechanism feed line. In the event that this happens, the remaining ink flows freely out of the ink jet print mechanism wherein it can contaminate the print medium, leak back into the print system, or in some cases both.

Industrial ink jet print applications require specialized high-volume ink delivery systems. To overcome the shortcomings of existing ink jet industrial print systems, a customized housing, ink delivery and regulation systems are provided. The first object of the present invention is to prevent failure of the inventive device through internal contamination by foreign bodies. A related object of the invention is to prevent electrical failure caused by ink contamination on the inside of inventive device. It is also an object of the invention to provide tool free access and maintenance for the purpose of quick replacement of key components, specifically those relating to ink delivery and ink jet printing. For that purpose, a related object is to use readily available modular components wherein the ink jet mechanism may be removed and replaced by an operator of average skill, independently of the other components and without tools. Another object of the invention is to provide a low ink warning mechanism for the purpose of preventing a low ink condition which may result in ink freely flowing out of the ink jet print mechanism. Related to this object, yet another object of the invention to prevent contamination of the print medium in the event of a low ink condition. An additional object of the invention is to provide a valve system in which an external ink supply can quickly be connected or disconnected without the use of specialized tools. Yet another object of the invention is to provide a drain path for ink such that ink leakage resulting from a damaged print mechanism, ink regulation system or a low ink condition will not cause ink contamination of the print medium.

SUMMARY OF THE INVENTION

It is to be understood that both the foregoing and general description and the following detailed description are exemplary, but are not restrictive, of the inventive device. In accordance with the principles and objectives of the invention, the inventive device includes a ink jet print mechanism, custom enclosure and ink supply control mechanisms.

FIG. 1 and FIG. 2 represent the preferred embodiment of the inventive device 100, an industrial print mechanism capable of printing text or graphics in 1 color up to ½" in height. Inventive device 100 consists of a single print system 200 consisting of regulator 24, print cartridge 34, print stall 32 and gaskets 76A and 76B for the purpose of placing ½ inch of ink jet printing, consisting of text or characters in one color, on a print medium. The preferred embodiment utilizes a single print system for the simplicity of illustration, and not as a means of restriction. It is to be understood that alternate embodiments may include additional print systems 200 in one mechanical housing for the purpose of printing multiple colors, increasing the print height beyond the ½ inch a single print cartridge 34 can produce, or both. For example, FIG. 6 demonstrates how assembly 600 utilizes four print systems 200 to generate a maximum print height of two inches.

Inventive device 100 consists of eight, main components: (1) a cover 72, (2) a ink regulator system 24, (3) a ½" ink jet print cartridge 34, (4) a print stall 32, (5) two gaskets 76A and 76B, (6) a skid plate 78, (7) a chassis 63, (8) and two external mating points 59. Cover 72 is made out of stainless steel and serves to protect the electronic and mechanical elements of the system from environmental debris and water spray. It is attached to chassis 63 on the end closest to print cartridge 34 such that it opens from one side allowing access to the inside of inventive device 100. It secures to chassis 63 by way of a stainless steel latch, not shown, on the side opposite the pivot point. Part 70, one-half of a magnetic switch, is attached to cover 72, the second half, component 71 is attached to chassis 63. The switch may be used to cut power to the system when the cover is opened or to perform other functions.

Regulator assembly 24, which is secured to chassis 63, changes the pressure of the supply of ink going to print cartridge 34 and monitors the pressure of the ink coming from an external reservoir, not shown. Regulator 24 consists of an aluminum sheet metal housing encloses a pressure regulator, and a pressure switch. The housing has an ink inlet and outlet utilizing parts of a quick-connect and disconnect nature. Unregulated supply ink enters the regulator assembly at atmospheric pressure. The regulator reduces the ink pressure such that it is supplied to the print cartridge at less than atmospheric pressure. A wire harness, not shown, accepts the input from magnetic cover switch halves 70 and 71 at the front of regulator assembly 24. An external electrical connection to the magnetic switch is made at the back of regulator assembly 24.

Ink flows from regulator 24 to ink jet print cartridge 34 via a flexible hose with quick connect ends. Print cartridge 34 sits in print stall 32 and can easily be removed without tools for replacement. Print stall 34 is permanently attached such that the face fits snugly up against the front of chassis 63. Printing occurs through an opening in the front of chassis 63 in which the print mechanism portion of print cartridge 34 protrudes.

Gasket 76B fits in a milled recess in the back of skid plate 78. It prevents environmental contaminants from entering the system, and in the event the ink jet print mechanism is damaged or otherwise defective, the gasket prevents ink run-off from leaking into the system.

Skid plate 78 protects both the inventive device from misaligned print medium, e.g., boxes traveling down an assembly line, in addition, with the help of a guide rail installed on the opposite side of the assembly line, it aligns the print medium during printing operations. Skid plate 78 has a drip channel consisting of a vertical groove extending from the bottom center of the print area to the bottom of the skid plate. In the event of leaking ink from a damaged or defective print cartridge 34, the drip channel serves as a path for unwanted ink such that the ink does not flow onto the face of the skid plate where it could cause ink contamination of the print medium.

Chassis 63 anchors all the components of the print system and it makes up the lower half of an enclosure. Electrical and supply ink connections are made at the back of chassis 63 and printing occurs at the front.

The inventive device may be attached to one or two external support members via four tapped holes in chassis 63. Unused mounting holes may be covered with anodized aluminum plate 59.

DETAILED DESCRIPTION OF THE INVENTION

Figure 1:
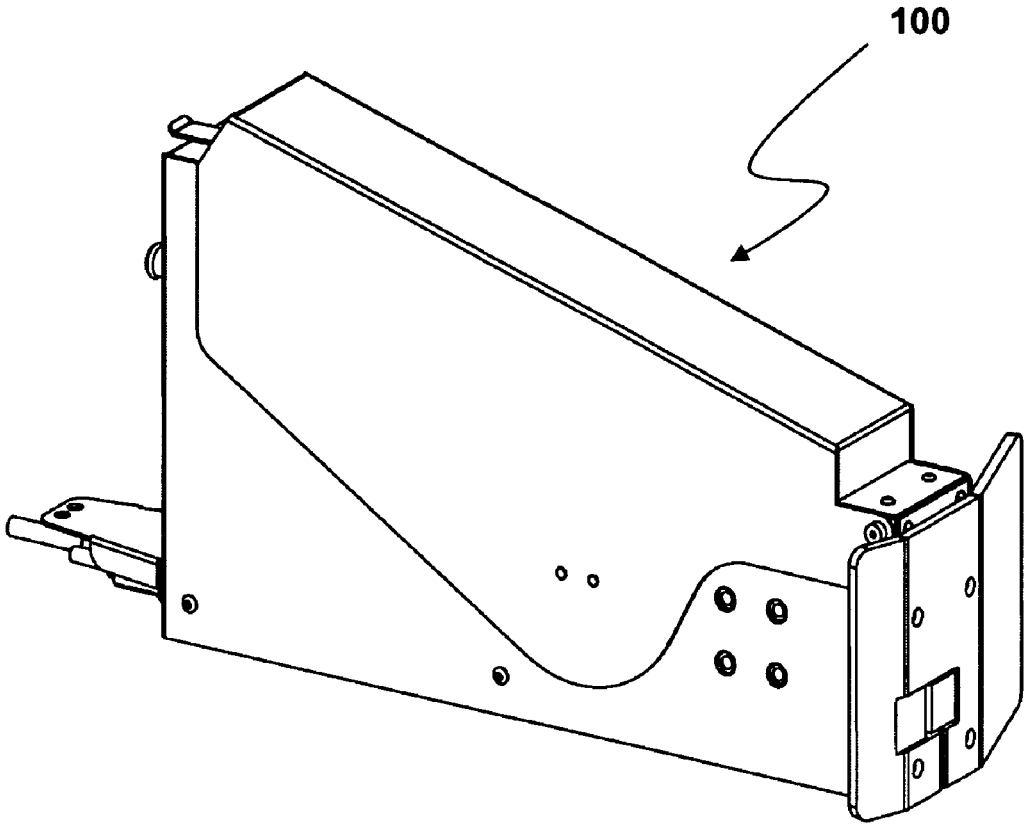
FIG. 1 A drawing containing an isometric view of inventive device 100.

For simplicity and illustrative purposes, the principles of the inventive device are described by referring mainly to an exemplary embodiment thereof, particularly with references to an example of the inventive device. However, one of ordinary skill in the art would readily recognize that the same principles are equally applicable to, and can be implemented in, any device designed to print in a similar manner.

Referring to all the drawings, it is to be understood that, according to common practice, the various components of the drawing may or may not be to scale. Reference numerals refer to components throughout the drawings.

FIG. 1 shows the preferred embodiment of the inventive device, inventive device 100: an industrial ink jet print system capable of producing a half-inch of print height in one color. The preferred embodiment utilizes a single print system for the simplicity of illustration, and not as a means of restriction. It is to be understood that alternate embodiments may include additional print systems 200 in one mechanical housing for the purpose of printing more than one color and print height greater than the ½ inch of print a single print cartridge 34 can produce. For example, FIG. 6 demonstrates how assembly 600 utilizes four print systems 200 to generate a maximum printing height of two inches. Alternate embodiments are discussed in detail further on.

Figure 2:
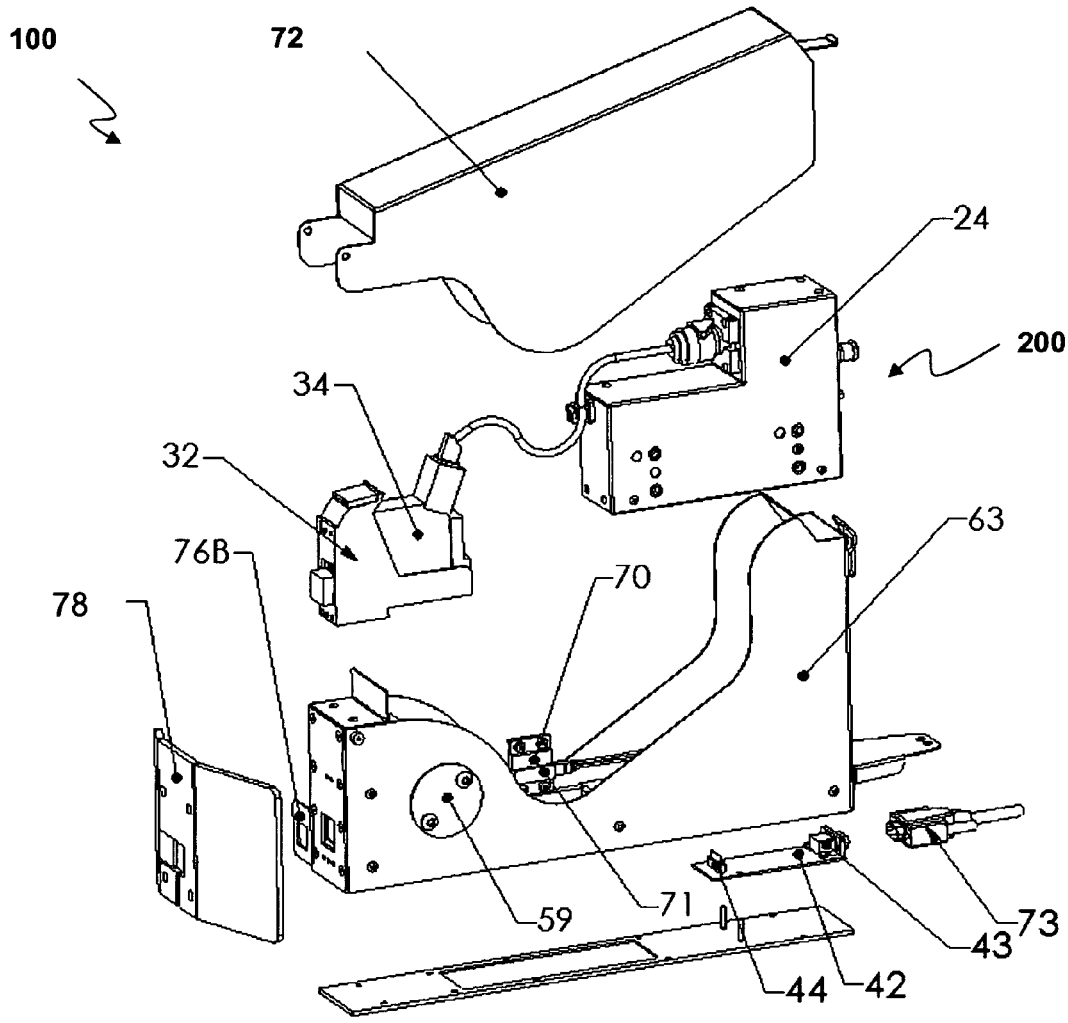
FIG. 2 A blown up isometric view of inventive device 100 and its sub assemblies.

As illustrated in FIG. 2, inventive device 100 consists of eight main components: cover 72, ink regulator system 24, ½" ink jet print cartridge 34, print stall 32, two gaskets 76A, not shown, and 76B, skid plate 78, chassis 63, and two external mating points 59.

Figure 5:
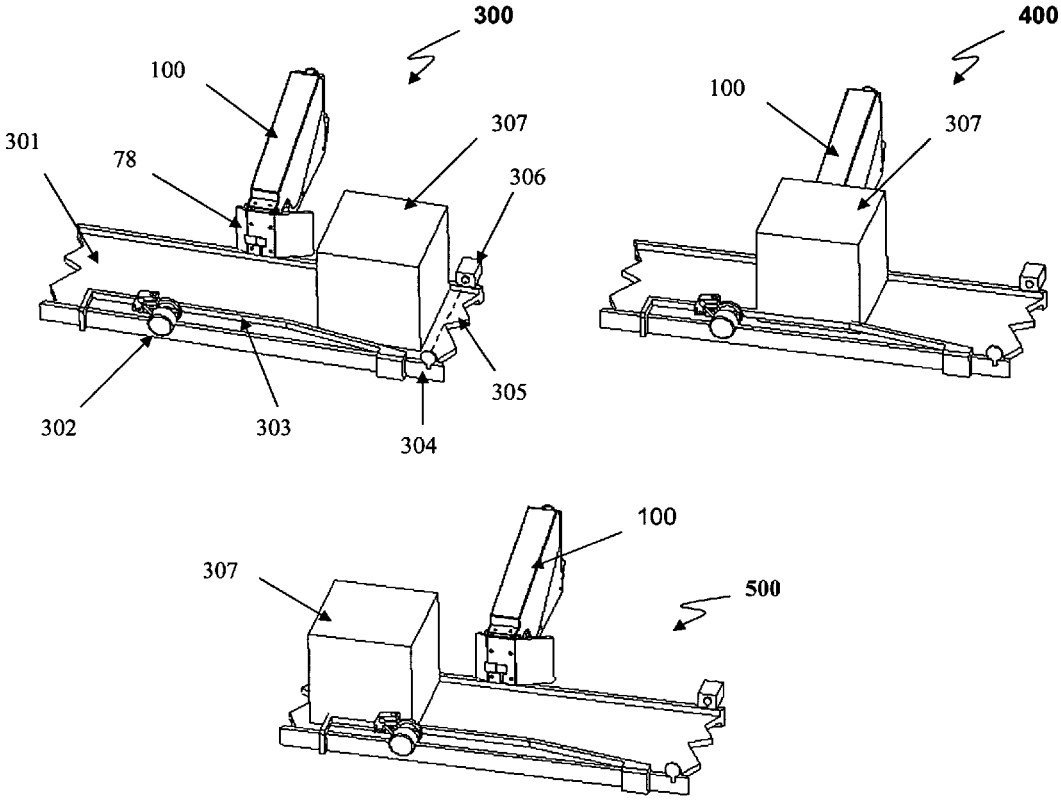
FIG. 5 shows print medium 307 moving down assembly line 301 in sequential steps: 300, 400 and 500 for the purpose of demonstrating how inventive device 100 operates during a typical printing operation.

The object of inventive device 100, as it pertains to FIG. 5 is to produce a half inch of print, consisting of text or graphics, on print medium. In the preferred embodiment the print medium is box 307, as shown in FIG. 5, a typical product box, however, it is to be understood that inventive device 100 shall not be restricted to printing on boxes, and may be used to print on any medium capable of accepting the ink used in the ink-jet printing process. For the purpose of illustration, such mediums may include, but are not restricted to, paper, cardboard, ceramic tile, wood, concrete, plastic, metal, fabric and cloth.

FIG. 2 shows an exploded isometric view of inventive device 100. Stainless steel cover 72, is permanently attached to chassis 63 via two stainless steel 3⁄16"×⅛" shoulder screws, not shown, and fastens to the back of the chassis using a stainless steel latch, also not shown. Cover 72 is designed to overlap the chassis in such a manner as to prevent environmental debris, such as airborne contaminants and dripping water, from entering inventive device 100. Magnetic actuator 70, one half of a magnetic switch, attaches to the inside of cover 72. When cover 72 is closed, magnetic actuator 70 rests on top of magnetic sensor 71 resulting in a closed circuit on the magnetic switch. Magnetic switch state information may be used to cut power to inventive device 100 when cover 72 is opened, trigger a custom software driven operation, or all of the above.

Figure 3:
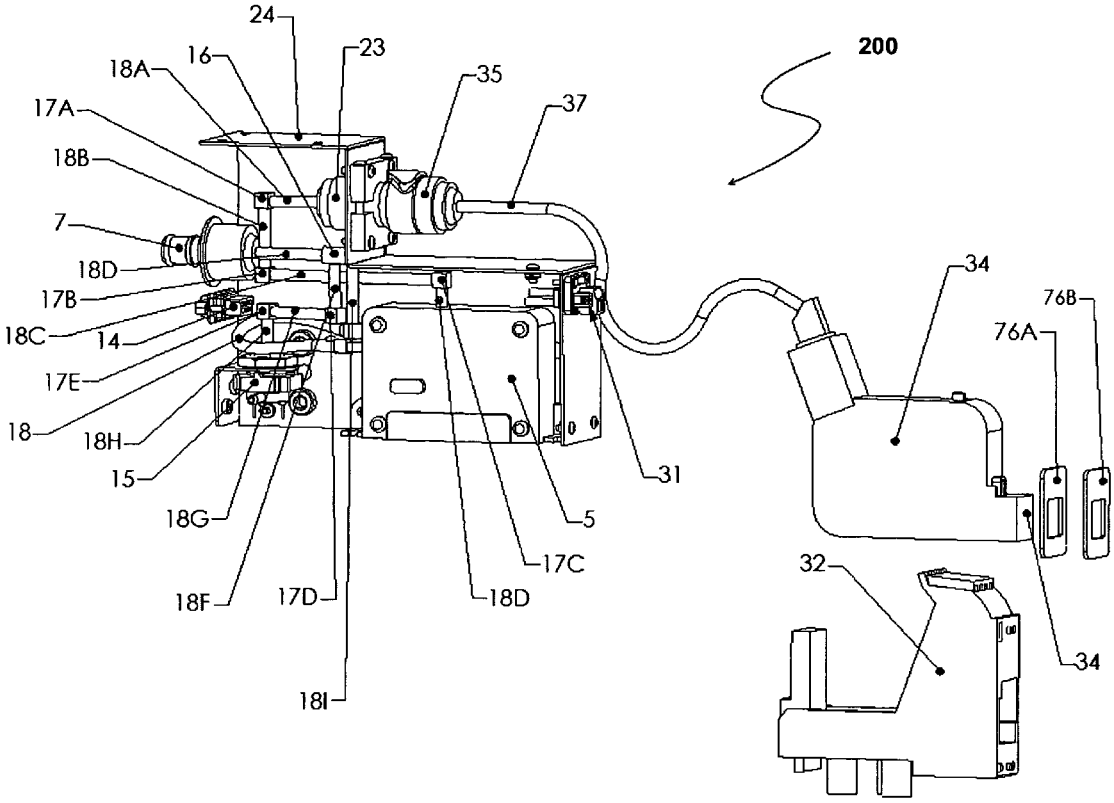
FIG. 3 A cutaway side view of inventive device 100's print sub assembly consisting of regulator 24, print cartridge 34 and print stall 36.
Figure 4:
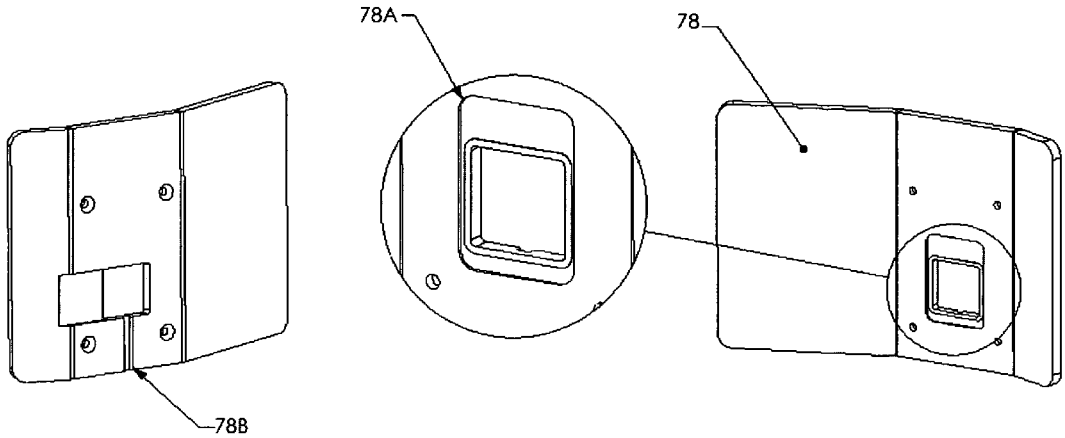
FIG. 4 contains isometric views of the front and back of skid plate 78 as well as a detailed view of the area in which the ink jet print mechanism portion of print cartridge 24 protrudes.

All the components of inventive device 100 are rigidly attached to chassis 63. Regulator assembly 24 attaches to the back of chassis 63 by four #6-32 screws, not shown. Print stall 32 rigidly attaches to the front of chassis 63 by four #4-40 screws, not shown, and utilizes gasket 76A, which is not visible in this figure, but is shown in FIG. 3, to seal the gap between the front of print stall 32 and chassis 63. A second gasket 76B seals the gap between skid plate 78 and chassis 63. The use of two gaskets: 76A and 76B, ensures that ink from a damaged or defective print cartridge 34 or regulator assembly 24 will not penetrate inventive device 100, rather the ink will flow down milled drip channel 78B of skid plate 78 as shown in FIG. 4.

Custom circuit board 42 takes input from an external controller, not shown, via high density 15 pin cable 73 made up of a cable consisting of seven individually shielded twisted wire pairs and both male and female high density 15 pin cable ends. High density 15 pin cable 73 mates to 15 pin DB-9M connection 43 at the back of circuit board 42. Electrical input is routed such that 15 pin DB-9M connection 43 electrical input is transferred to a 14 pin ribbon cable, not shown, that mates to ribbon connector 44 the front of circuit board 42 on the inside of the inventive device 100. The ribbon cable, not shown, transmits the electrical input from the external controller, not shown, to print stall 32.

FIG. 3, shows print sub assembly 200, consisting of regulator assembly 24, ½ inch ink jet print cartridge 34, print stall 32 and two gaskets 76A and 76B. Note: regulator assembly 24 appears with various sheet metal components hidden for the purpose of illustrating the inner mechanics. Regulator assembly 24 consists of a sheet metal enclosure and integrated components. Supply ink, which comes from an external reservoir, not shown, that is located a minimum of 13" above the center of male panel mount connector 7 and vented to atmospheric pressure, enters regulator assembly 24 through ⅛" male panel mount connector 7 and travels through ⅛" inner diameter flexible tubing 18D to three-port manifold 16. Three-port manifold 16 connects ink of common pressure to two separate mechanisms: pressure switch 15 and print pressure regulator 5. The first of two exit ports on three-port manifold 16 connect the supply ink to pressure switch 15 via three flexible tubes 18F, 18G and 18H, and two 90° tube elbows 17D and 17E. Pressure switch 15 has an integrated electrical switch capable of two states: open and closed. Pressure switch 15 is in an open state when the supply ink pressure is above ten inches of water. When the supply ink pressure drops below that level pressure switch 15 changes to a closed state. This information may be used by an external control device to cut power to inventive device 100, send a signal to the equipment operator of a low ink condition, trigger a custom software driven action, or all of the above.

The second exit port on three-port manifold 16 feeds ink to print pressure regulator 5 via flexible tube 18I, which connects to 90° tube elbow, not labeled, and then flexible tube 18. Print pressure regulator 5 supplies ink to ½ inch ink jet print cartridge 34, at less than atmospheric pressure for the purpose of preventing ink from freely flowing to print cartridge 34 when it is not in operation. Ink travels from pressure regulator 5 to jet print cartridge 34 via flexible tubes and connectors, 18D, 17C, 18C, 18B, 17A, 18A, 23, 35, and 37, respectively. Note that panel mount connector 23 rigidly attaches to regulator assembly 24 and that ⅛" ID quick connector 35 is attached to ⅛" flexible plastic tube 37.

DB-9M connector 14 makes an electrical connection via wires, not shown, through regulator assembly 24 and mates with COMBICON, 3.81 mm, two-circuit plug 31. Wires coming from magnetic sensor 63, not shown, plug into the COMBICON, 3.81 mm, two-circuit plug 18. Connection to an external device is made via DB-9M 14 connector.

Print cartridge 34 fits into the print stall 32 which is rigidly attached to the chassis 63, as shown in FIG. 2. With further respect to FIG. 3, Gasket 76A fits between print stall 32 and a face plate on the front of chassis 63, not shown, to prevent ink from leaking back into inventive device 100 in the event of a damaged or defective print cartridge 34 or pressure regulator 5.

FIG. 4, shows isometric front and back views of skid plate 78, an aluminum member used to align box 307 prior to and during the print process. As shown in FIG. 5, printing occurs in one direction, whereas inventive device 100 is positioned such that box 307, transported an assembly line 301, approaches the side of inventive device 100 defined by the large flap on skid plate 78 first.

The back of skid plate 78 contains a milled groove in which gasket 76B, as shown in FIG. 4 seals the gap between skid plate 78 and chassis 63, for the purpose of preventing ink, water or other contaminants from entering inventive device 100. In this respect, milled discharge groove 78B in the front face of skid plate 78 allows ink from a damaged or defective print cartridge 34 to be dispelled without contacting the face of skid plate 78. This prevents ink contamination of the print medium, such as box 307 in FIG. 5, in the event of a print system failure.

FIG. 5 demonstrates how inventive device 100 prints on box 307. Note that FIG. 5 is shown for illustrative purposes and thus inventive device 100 and assembly line 301 are shown without any structural supports and floating in space. In position 300 box 307 approaches inventive device 100 on assembly line 301. Optical sensor 306 shoots beam of light 305 to reflector 304. Beam of light 305 is broken by box 307 as it travels down assembly line 301. Digital encoder 302 contains a wheel in direct contact with assembly line 301 for the purpose of determining the velocity of the assembly line, and by extension, box 307. The velocity information of assembly line 301, and the amount of time beam of light 305 is interrupted by box 307, is used to determine the length of box 307 for the purpose of centering, or otherwise positioning, ink jet printing on box 307. Rail 303 pushes box 307 against skid plate 78 during the printing process. In position 400, inventive device 100 applies ink jet print on box 307. In position 500, box 307 has received print from inventive device 100 and continues down assembly line 301.

Figure 6:
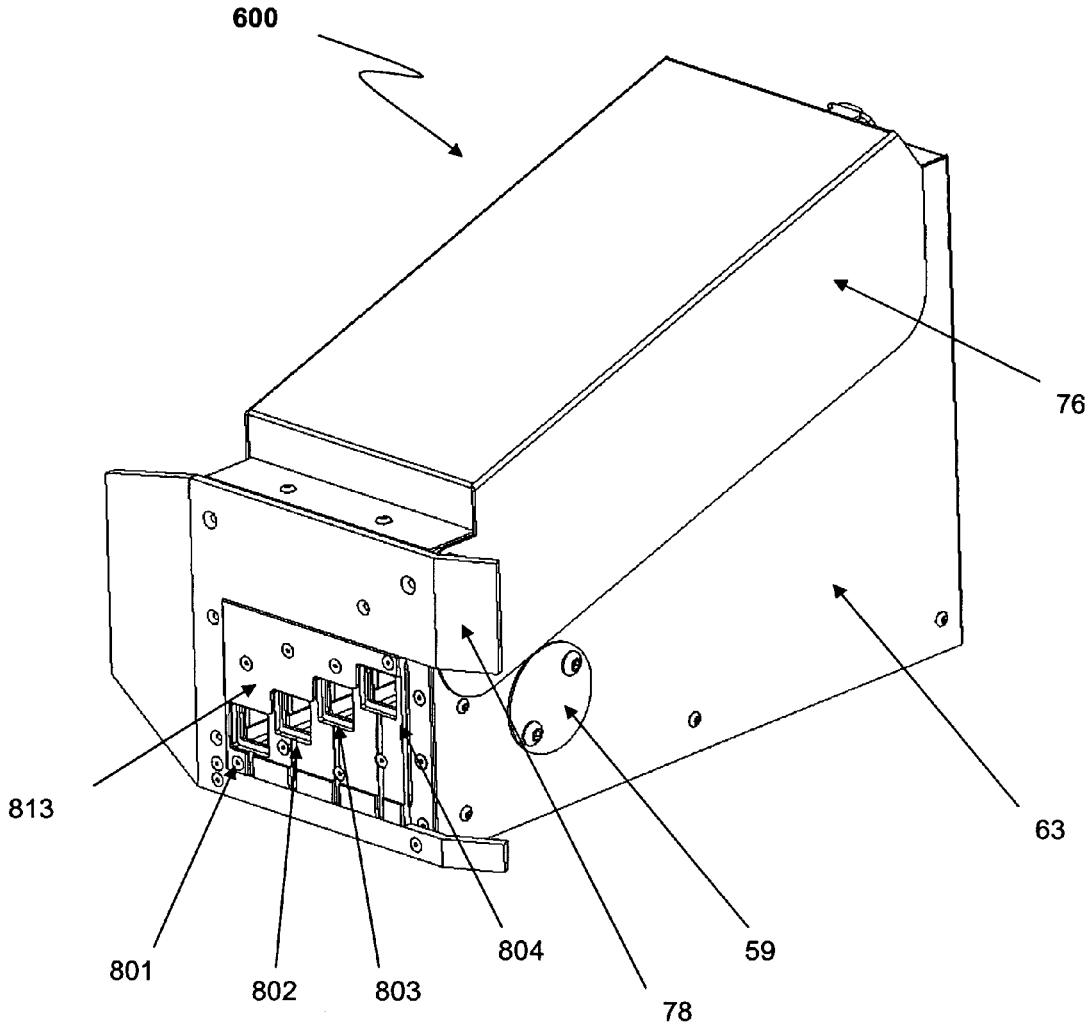
FIG. 6 shows assembly 600, an alternative embodiment of the present invention consisting of multiple print systems 200 combined in one housing.

FIG. 6 shows assembly 600, an alternative embodiment of inventive device 100. Whereas inventive device 100 is capable of producing ½ inch of print height, assembly 600 can produce two inches of print height by staggering multiple print cartridges 34 vertically. Assembly 600 contains four inkjet print cartridges 34, not shown, that pass through openings: 801, 802, 803, and 804. The enclosure components of assembly 600 are the same as inventive device 100—it has one chassis 63, one cover 76, and two external mating points 59, however, assembly 600 incorporates four sub assemblies 200, as shown in FIG. 3 to produce two inches of print height. Print cartridges 34 pass through openings 801, 802, 803, and 804 and are staggered such that, the bottom of print cartridge 34, not shown, that protrudes through opening 802 occurs at the top of print cartridge 34, also not shown, protruding through opening 801, and so fourth. An external controller electronically links the four sub assembly 200 systems such that a print task is broken up and shared between multiple print cartridges 34 so that they, collectively, can produce one print image.

Figure 7:
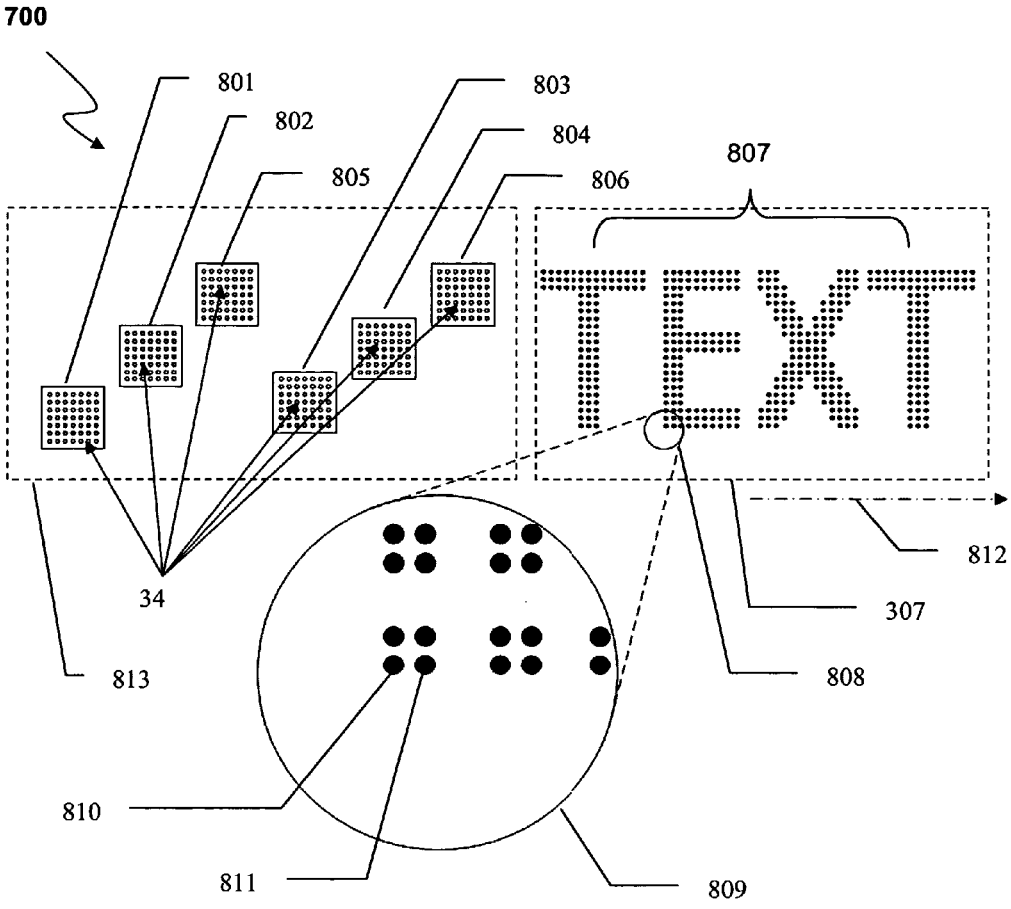
FIG. 7 illustrates how multiple print cartridges 34 combine to form alternative embodiment 700—an embodiment capable of producing two color text or graphics up to 1.5 inches in height.

FIG. 7 shows alternate embodiment 700 of inventive device 100 wherein multiple print cartridges 34 are combined to produce multicolor print (text or graphics) on print medium 307. Area 813 represents the face of the inventive device, as shown in FIG. 6. Printing 807 is shown to illustrate print, in this case the word "TEXT" applied to print medium 307 in the direction indicated by line 812. Print faces 801, 802, 803, 804,

805 and 806 represent the faces of print cartridges 34 containing ink jet print nozzles. The print cartridges 34 are placed so that the tops and bottoms are coplanar, for example, the bottom of print face 802 aligns with the top of print face 801. This is done so that there is no gap in printing between the top and bottom of two adjacent print cartridges 34. The dot matrix in print face 801 represents an array of small ink jet nozzles which pulse ink on print medium 307 as dictated by and external controller, not shown. Ink jet nozzles apply ink by pulse firing tiny ink droplets, such as drops 810 and 811, to form printing 807. By stacking/staggering print faces 801, 802 and 803, embodiment 700 can print up to 1.5 inches of print height on print medium 307. By using one ink color in print cartridges 34 protruding through faces 801, 802 and 803, and a different color ink in print cartridges 34 protruding through print faces 803, 804 and 805, alternate embodiment 700 can perform two color printing operations. Additionally, more print cartridges 34 may be added in the fashion shown to print an unlimited number of colors.

Figure 8:
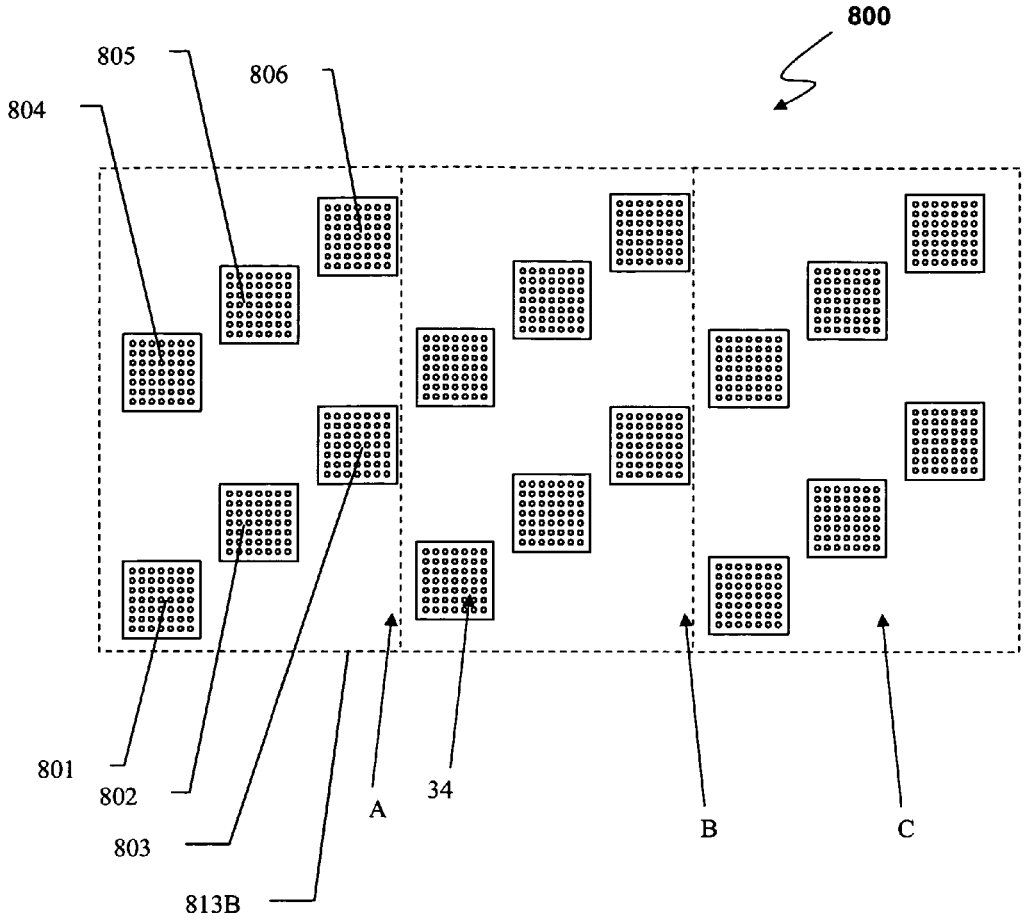
FIG. 8 Alternative embodiment 800 consists of a configuration of print cartridges 34 arranged such they can produce print a maximum of three inches tall and consisting of one to three colors.

FIG. 8 shows alternative embodiment 800 for the purpose of demonstrating how print cartridges 34 may be combined to produce three color print three inches in height. Area 813B represents the face of the inventive device, as shown in FIG. 6 Sub areas A, B and C each contain six print cartridges 34. In area A, print faces 801 thru 806 combine to yield a print height of 3 inches. Additionally, areas A, B and C may be configured such that each area prints a different color.

The staggered print cartridge pattern shown in area A, B and C may be repeated in both the vertical and horizontal directions to create additional alternative embodiments of the inventive device. This method of staggering can be used to create print consisting of an unlimited number of colors and print height.

The invention claimed is:

1. In a print mechanism a having housing, a cover pivotably connected to said housing, regulating ink flow control means mounted in said housing, and a print cartridge operatively connected to said regulating ink flow control means mounted in said housing the improvement being;

a skid plate mounted to the housing and contacting the print medium for ensuring alignment of print medium with respect to said print cartridge, a print stall for maintaining said print cartridge in proper position located in said housing for efficient print applications, a first seal positioned inside said housing between said print stall and said housing to prevent ink leakage, a second seal positioned between said skid plate and said housing means for preventing contamination and ink leakage, said first and second seal being separated by a common wall of said housing and;

an elongated channel formed on said skid plate wherein ink can flow in the space provided by said channel in a direction away from said regulating ink flow control means.

* * * * *